US005566931A

United States Patent [19]

Considine

[11] Patent Number: 5,566,931

[45] Date of Patent: Oct. 22, 1996

[54] STRUCTURAL PANEL JIG APPARATUS AND METHOD OF USE

[75] Inventor: Richard Considine, Chestertown, N.Y.

[73] Assignee: Cornucopia Products Inc., Chestertown, N.Y.

[21] Appl. No.: 324,139

[22] Filed: Dec. 9, 1994

[51] Int. Cl.[6] ..... B25B 5/14

[52] U.S. Cl. ..... 269/111; 269/303; 269/307

[58] Field of Search ..... 269/111, 303, 269/304, 305, 307, 315, 910, 41; 29/281.3; 33/464, 526, 527, 562; 100/913

[56] References Cited

U.S. PATENT DOCUMENTS

| | | | |
|---|---|---|---|
| 2,305,124 | 12/1942 | Wilson et al. | 269/305 |
| 3,065,550 | 11/1962 | Pattiani . | |
| 3,066,962 | 12/1962 | Koehler | 269/111 |
| 3,540,130 | 11/1970 | French | 33/562 |
| 3,866,644 | 2/1975 | Stubbs . | |
| 3,933,348 | 1/1976 | Tidwell, Jr. | 269/303 |
| 4,236,702 | 12/1980 | Keddie | 269/41 |
| 4,541,618 | 9/1985 | Bruno . | |
| 4,841,710 | 6/1989 | Considine . | |

FOREIGN PATENT DOCUMENTS

| | | |
|---|---|---|
| 385765 | 12/1964 | Switzerland . |

*Primary Examiner*—Robert C. Watson
*Assistant Examiner*—Thomas W. Lynch
*Attorney, Agent, or Firm*—Henderson & Sturm

[57] ABSTRACT

A wall panel jig apparatus (10) for fabricating a variety of conventional and/or extended wall panel segments including corner panel segments (110) window panel segments (120) standard panel segments (130) entry door panel segments (140) and end panel segments (150) wherein the jig apparatus (10) comprises a rectangular framework including top (20) bottom (30) right side (40) and left side (50) frame members for joining conventional top plates, shoe plates and studs into conventional wall panel segments by nailing.

10 Claims, 6 Drawing Sheets

STRUCTURAL PANEL JIG APPARATUS AND METHOD OF USE

TECHNICAL FIELD

The present invention relates to the field of wall panel assembly systems in general, and in particular to a new method and apparatus for assembling prefabricated wall panels and the like for residential construction.

BACKGROUND ART

As can be seen by reference to the following U.S. Pat. Nos. 3,065,550; 3,866,644; 4,541,618; and 4,841,710; the prior art is replete with myriad and diverse systems for fabricating framed building panel components.

While all of the aforementioned prior art constructions are more than adequate for the basic purpose and function for which they have been specifically designed, these patented systems are limited to either a single or at best a narrow range of different building panels that can be produced by the use thereof.

Given the current cost of purchasing a new home many couples and/or individuals are seeking alternative ways of either building their own homes, adding additions and/or extensively remodeling the interiors of their present homes.

As a consequence of the foregoing situation, there has existed a longstanding need among do it yourselfers and other individuals on a limited budget for a new type of wall panel jig which will allow the user to quickly, easily and inexpensively fabricate precut lumber sections into the various types and shapes of structural wall panels that are necessary to support a building structure; and, the provision of such a construction is a stated objective of the present invention.

DISCLOSURE OF THE INVENTION

Briefly stated, the wall panel jig apparatus and method of use that forms the basis of the present invention comprises a generally rectangular framing unit including a plurality of specially configured framing members that cooperate with one another to produce the generally rectangular configuration of the framing unit.

In addition the framing unit is further provided with spacer elements that are releasably attached to selected ones on the framing members to create an offset for the horizontally disposed pre-cut lumber sections that are used to fabricate a number of the panel components that will be employed in the construction of the house.

As will be explained in greater detail further on in the specification, the wall panel jig apparatus of this invention can be employed to fabricate all of the following panel components: corner panels; window panels; standard panels; entry door panels; and end wall panels that would be required in the construction of a conventional house.

Furthermore, all of the aforementioned panel components can be assembled in anywhere from five to fifteen minutes whereby the user can conceivably fabricate all of the structural wall panel components for an average 1200 square foot house in less than 8 hours at a cost of less than $12.00 per square foot to erect the shell and meet all building codes.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
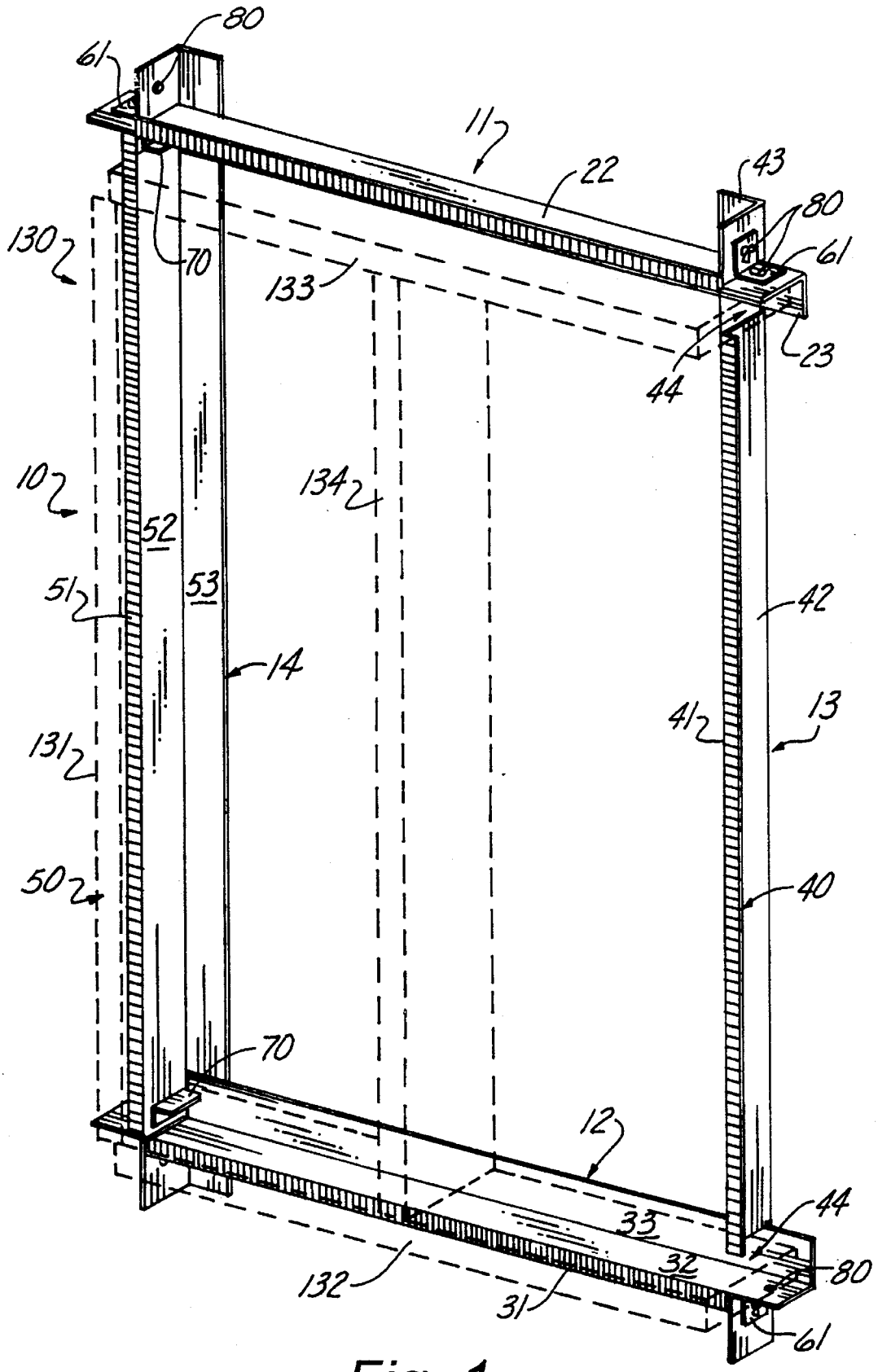
FIG. 1 is a perspective view of the wall panel jig apparatus that forms the basis of the present invention being employed to fabricate a standard panel component.

As can be seen by reference to the drawings, and in particular to FIG. 1, the wall panel jig apparatus that forms the basis of the present invention is designated generally by the reference numeral (10). The jig apparatus (10) comprises in general a top frame unit (11) a bottom frame unit (12) a right side frame unit (13) and a left side frame unit (14). These units will now be described in seriatim fashion.

Figure 3:
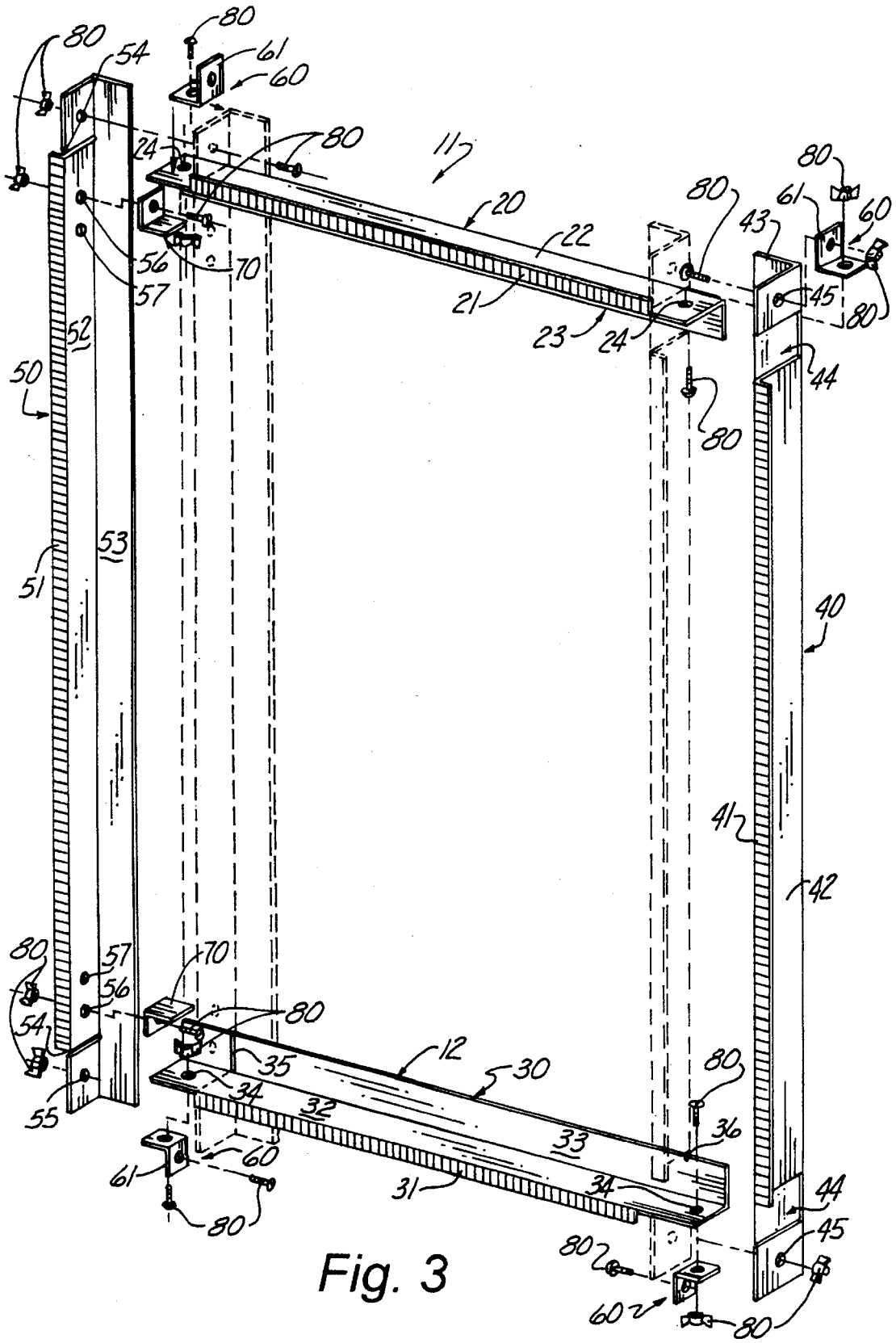
FIG. 3 is an exploded perspective view of the wall panel jig apparatus.
Figure 4:
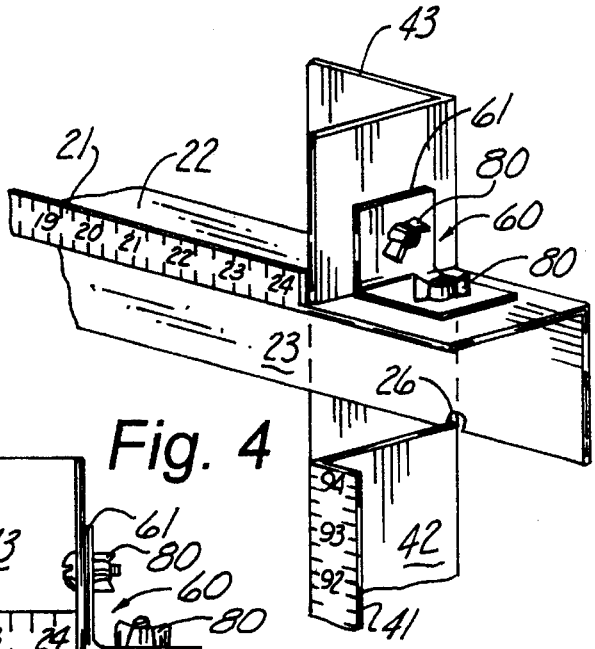
FIG. 4 is a perspective view of the juncture of the top frame member with the right side frame member.
Figure 5:
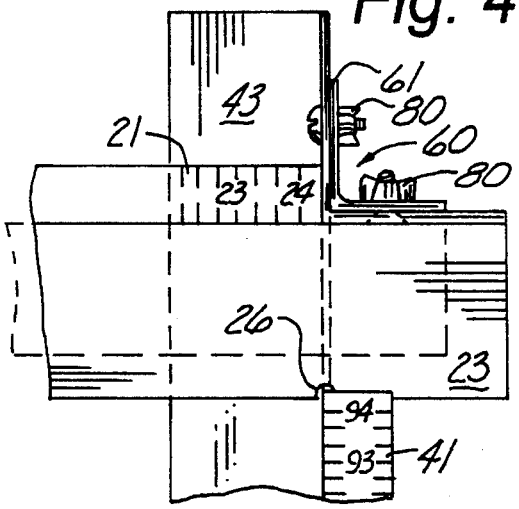
FIG. 5 is a front view of the juncture of the top frame member with the right side frame member.

As can best be seen by reference to FIG. 3, the top frame unit (11 ) comprises an elongated generally rigid top frame member (20) having a front indexing portion (21 ) disposed generally perpendicular to the edge of a leading elongated intermediate portion (22) wherein the trailing edge of the intermediate portion (22) is provided with an elongated rear base portion (23) which is disposed generally perpendicular to the intermediate portion (22); and, wherein the front indexing portion (21) and the rear base portions (23) are faced in opposite directions to one another.

At this juncture it should be noted that all of the remaining frame units (12), (13) and (14) all comprise generally elongated rigid frame members (30), (40) and (50) respectively, having the same interrelationship between their front indexing portions (31), (41) and (51) portions (32), (42) and (52) and rear base portions (33), (43) and (53) as set forth in the description of the top frame unit (11).

Still referring to FIG. 3 it should further be noted that both the top (20) and bottom (30) frame members are mirror images of one another; wherein the opposite ends of the intermediate portions (22) and (32) are provided with discrete apertures (24) and (34) respectively. In addition the left hand side of the top and bottoms rear base portions (23) and

(33) are provided with elongated narrow slits (25) and (35) respectively and the right hand side of the top and bottom rear base portions (23) and (33) are provided with shallow narrow slits (26) and (36) respectively; wherein the purpose and function of the apertures (24) and (34) and the slits (25), (26), (35) and (36) will be explained further on in the specification.

Again as can best be seen by reference to FIG. 3 the intermediate portion (42) of the right side frame member (40) is provided with a pair of enlarged slots (44) disposed proximate to the terminus of the right side front indexing portion (41); and a pair of discrete apertures (45) deposed on the: opposite ends of the intermediate portion (42).

On the other hand, the intermediate portion (52) of the left side frame member (50) is provided with a pair of elongated narrow slots (54) disposed proximate to the terminus of the left side indexing portion (51); a pair of discrete apertures (55) disposed on the opposite ends of the intermediate portion (52); and, twin pairs of discrete apertures (56) and (57) spaced inwardly from the terminus of the left side indexing portion (51).

As shown in FIGS. 2 through 5 a plurality of interchangeable bracket means (60) are employed to attach the frame members (20), (40), (30), and (50) together into a generally rectangular configuration; wherein, the bracket means (60) comprise a generally L-shaped bracket member (61) wherein each of the arms of the bracket member (61) are apertured to receive conventional fastening means (80) to connect the outer ends of the frame members together in a well recognized fashion.

Figure 6:
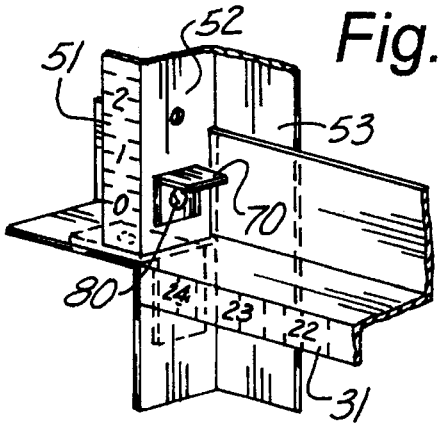
FIG. 6 is a perspective view of the juncture of the left side frame member with the bottom frame member.
Figure 7:
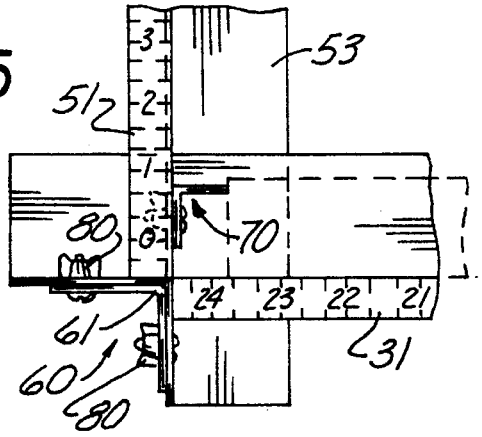
FIG. 7 is front view of the juncture of the left side frame member with the bottom frame member.

Turning now to FIGS. 3, 6 and 7, it can be seen that both the upper and lower ends of the left side frame member (50) are provided with spacer elements (70) which may be selectively secured through either one of the twin pairs of apertures (56) and (57) on the left side frame member by the conventional fastening means (80).

Figure 9:
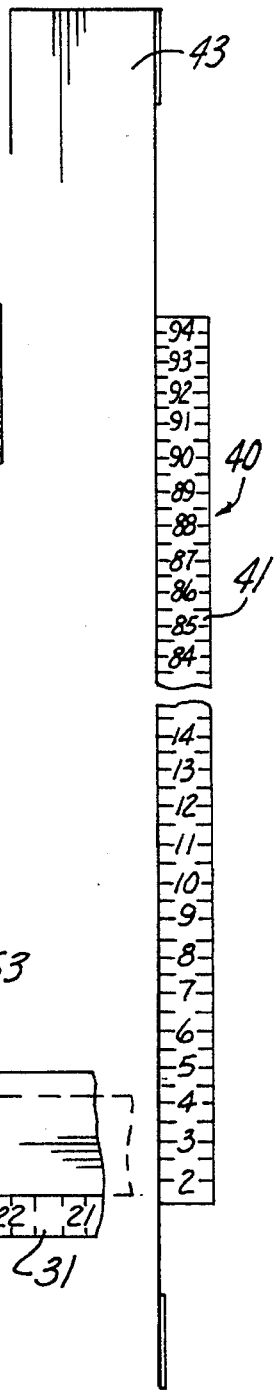
FIG. 9 is a front view of the measuring indicia imprinted on the right and left side frame members.
Figure 8:
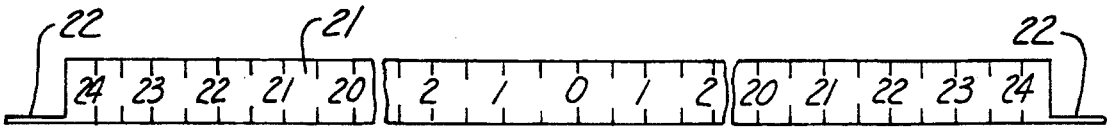
FIG. 8 is a front view of the measuring indicia imprinted on the top and bottom frame members.

As can be seen by reference to FIGS. 7 through 9, the scale indicia on the front indexing portions (21) and (31) on both the top and bottom frame members (20) and (30) have a midpoint of "zero" with the scale indicia increasing towards both ends, while the scale indicia on the front indexing portions (41) and (51) on both the fight and left side frame members (40) and (50) have an indicia increasing from "zero" from the bottom of the vertical indexing portions (41) and (51) to the top thereof.

Figure 11:
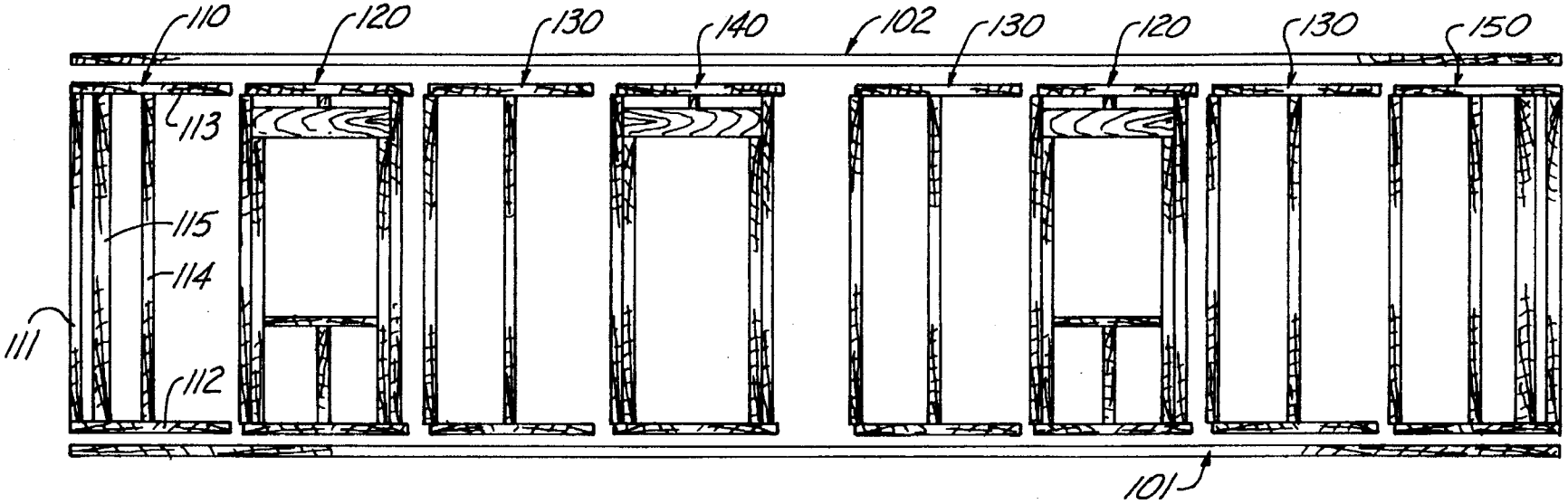

As can best be seen by reference to FIG. 11 the jig apparatus (10) of this invention can be employed to produce the following conventional and/or extended building panel segments; a corner panel segment (110); a window panel segment (120); a standard panel segment (130); and entry door panel segment (140); and an end wall panel segment (150); wherein, the panel segments are joined together into a finished wall segment by fastening the bottom of the panel segments to a box sill (101) and fastening a double top plate (102) to the top plates of the panel segments.

As can also be seen by reference to FIG. 11 virtually all of the panel segments, with the exception of the corner panel (110) have a lateral offset formed between at least one vertical stud and the horizontal shoe plate and top plate of the respective panel segments to facilitate the attachment of the panel segments to one another, as will be explained in greater entail presently.

One example of a panel segment that may be fabricated by employing the jig apparatus (10) of this invention is illustrated in phantom in FIG. 1 and involves a standard panel segment (130). In order to fabricate this particular panel segment the spacer elements (70) are deployed on the upper and lower ends of the left side frame member (50). The left stud (131) rests between the spacer elements (70) and in an abutting relationship with the intermediate (52) and rear (53) portions of the frame member (50). The shoe plate (132) and top plate (133) are then introduced through the enlarged openings (44) in the right frame member (40) such that the left ends of the plate sections (132) and (133) engage the leading edge of the spacer elements (70) while being in an abutting relationship with the intermediate (22) and (32) and rear (23) and (33) of the top and bottom frame members (20) and (30) respectively.

At this juncture the top plate (132) is nailed to the top of the left stud (131) and then the shoe plate (133) is secured likewise. Then a center stud (134) is positioned relative to a preapplied pencil mark on the top plate (133) and the shoe plate (132), and nailed thereto in the same sequence as the left stud (131).

Figure 2:
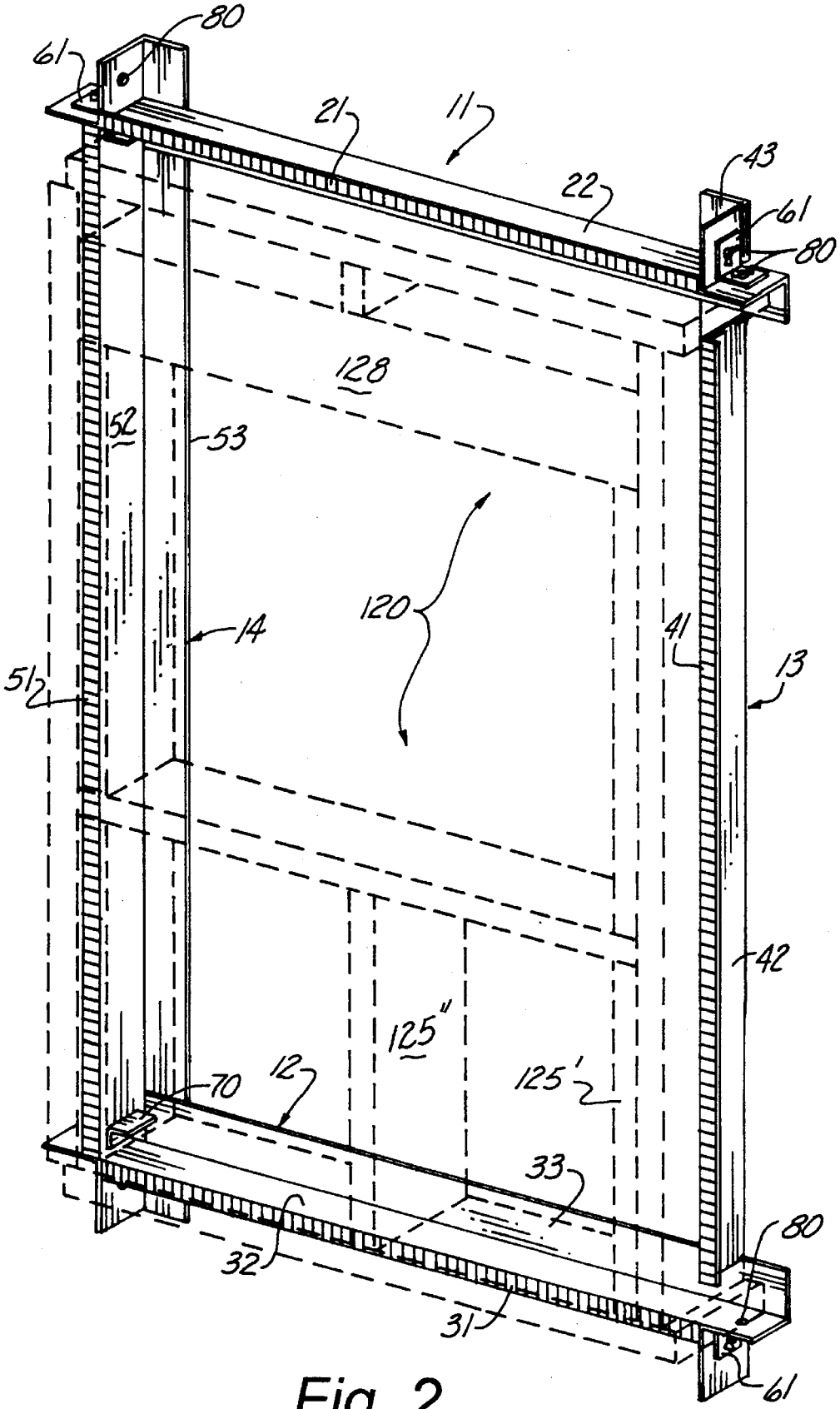
FIG. 2 is a perspective view of the jig apparatus being employed to fabricate a window panel component.
Figure 10:
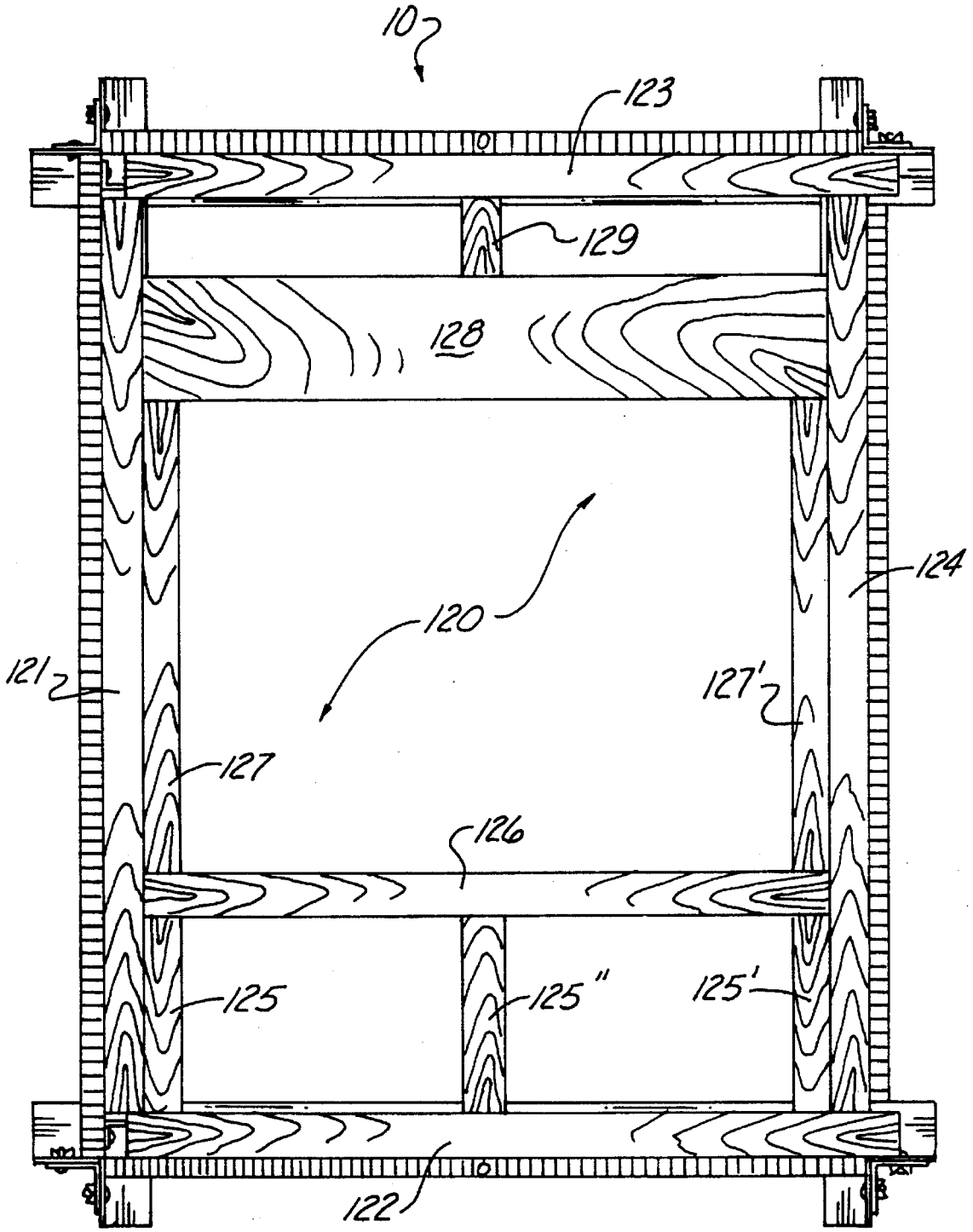
FIG. 10 is a front view of a window panel construction assembled within the jig apparatus; and, FIG. 11 is an illustrative view of the various panel components that may be fabricated by using the method and apparatus of this invention.

Another example of a panel segment that may be fabricated in accordance with the teachings of this invention is a window panel segment (120) depicted in FIGS. 2 and 10. As can best be seen by reference to FIG. 10 the window panel segment (120) is initially fabricated along the same lines as the standard panel segment (130) in the connection of the top plate (123) and shoe plate (122) to the left stud (121) using the spacer elements (70) as before.

At this juncture the right stud (124) is placed in between the top plate (123) and shoe plate (122) and into abutment with the intermediate (42) and rear (43) portions of the right side frame member (40); wherein, the top plate (123) is first nailed to the top of the right stud (124) and then the bottom of the right stud (124) is nailed to the top of the shoe plate (122).

The next step is to secure two lower jack studs (125) and (125') to the lower portion of the left (121) and fight (124) studs respectively; attach the sill plate (126) to the top of the lower jack studs (125) and (125'); and, then attach a lower cripple (125") intermediate the midpoint of the sill plate (126) and the shoe plate (122).

At this point a pair of upper jack studs (127) and (127') are attached to the left (121) and right (124) studs respectively; wherein, the bottom of the upper jack studs (127) and (127') are resting on the upper ends of the sill plate (126). Then the box header (128) is attached to the top of the upper jack studs (127) and (127'); and, an upper cripple (129) is installed intermediate the midpoint of the top of the box header (128) and the bottom of the top plate (123).

Turning once more to FIG. 11 it can be appreciated that only the fabrication of the comer panel segment (110) involves the removal of the spacer elements (70) from the left side frame member (50) of the jig apparatus (10). It should also be noted that for this particular panel segment, the left ends of the top (113) and shoe (112) plates be completely across the top and bottom of the left stud (111) and nailer stud (115) is disposed between the center stud (114) and the left stud (111) at a location proximate to, but spaced from, the left stud It should further be noted that the jig apparatus (10) of this invention also contemplates the use of a second jig apparatus to increase the horizontal width of the panel segments that may be fabricated thereby; wherein, the second jig apparatus is deployed in an inverted position relative to the first jig apparatus, such that the enlarged openings (44) normally disposed on the right hand frame member (40) are now located on the left hand frame: member (50) of the inverted second jig apparatus.

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

I claim:

1. A structural panel jig apparatus for the fabrication of a variety of conventional structural panel segments including but not limited to: corner panel segments; window panel segments; standard panel segments; entry door panel segments; and, end wall panel segments wherein said jig apparatus comprises:

a top frame member, a bottom frame member, a right side frame member and a left side frame member; wherein, all of the frame members are provided with a front indexing portion, an intermediate portion, and a rear base portion; the top frame member and the bottom frame members are mirror images of one another; and, wherein, the rear base portion of the top frame member is provided with an elongated slit dimensioned to receive the intermediate, portion of the left side frame member; and, fastening means for assembling the frame members into a generally rectangular configuration wherein the right side frame member is provided with a pair of enlarged slots dimensioned to receive the top plate and the shoe plate of said conventional structural panel segments.

2. The jig apparatus as in claim 1; wherein the indexing portions of each frame member are provided with measuring indicia and are disposed generally perpendicular to said intermediate portions of each frame member.

3. The jig apparatus as in claim 2; wherein, the rear base portions of each frame member are disposed generally perpendicular to said intermediate portions of each frame member.

4. The jig apparatus as in claim 3; wherein, the indexing portions and the rear base portions of each frame member are faced in opposite directions relative to said intermediate portions of each frame member.

5. The jig apparatus as in claim 1; wherein, the rear base portion of the top frame member is provided with a relatively shallow slit dimensioned to receive at least part of the intermediate portion of the right side frame member.

6. The jig apparatus as in claim 1; wherein, all of the frame members are provided with discrete apertures formed proximate their respective ends.

7. The jig apparatus as in claim 1; wherein, the left side frame member is provided with a pair of spacer elements that prevent the top plate and the shoe plate from coming into contact with the intermediate portions of the left side frame member.

8. A structural panel jig apparatus for the fabrication of a variety of conventional structural panel segments including but not limited to: corner panel segments; window panel segments; standard panel segments; entry door panel segments; and, end wall panel segments wherein said jig apparatus comprises:

a top frame member, a bottom frame member, a right side frame member and a left side frame member; wherein, all of the frame members are provided with a front indexing portion, an intermediate portion, and a rear base portion; the top frame member and the bottom frame member are mirror images of one another; all of the frame members are provided with discrete apertures formed proximate their respective ends; and, wherein the intermediate portion of the left side frame member is provided with a pair of elongated narrow slots dimensioned to receive the intermediate portions of said top and bottom frame members; and fastening means for assembling the frame members into a generally rectangular configuration wherein the right side frame member is provided with a pair of enlarged slots dimensioned to receive the top plate and the shoe plate of said conventional structural panel segments.

9. The jig apparatus as in claim 8; wherein the intermediate portion of the left side frame member is provided with at least one pair of discrete apertures disposed intermediate said elongated narrow slots.

10. A structural panel jig apparatus for the fabrication of a variety of conventional structural panel segments including but not limited to: corner panel ;segments; window panel segments; standard panel segments; entry door panel segments; and., end wall panel segments wherein said jig apparatus comprises:

a top frame member, a bottom frame member, a right side frame member and a left side frame member; wherein, all of the frame members are provided with a front indexing portion, an intermediate portion, and a rear base portion; the top frame member and the bottom frame members are mirror images of one another; and, wherein the intermediate portion of the right side frame member is provided with a pair of enlarged slots dimensioned to receive both the intermediate portions of the top and bottom frame members as well as the top plate and shoe plate; and, fastening means for assembling the frame members into a generally rectangular configuration wherein the right side frame member is provided with a pair of enlarged slots dimensioned to receive the top plate and the shoe plate of said conventional structural panel segments.

* * * * *